US009308627B2

(12) United States Patent
Chen

(10) Patent No.: US 9,308,627 B2
(45) Date of Patent: Apr. 12, 2016

(54) WRENCH DEVICE WITH A PLURALITY OF DRIVING HOLES

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 448 days.

(21) Appl. No.: 13/668,331

(22) Filed: Nov. 5, 2012

(65) Prior Publication Data

US 2014/0123816 A1 May 8, 2014

(51) Int. Cl.

| | |
|---|---|
| ***B25B 13/46*** | (2006.01) |
| ***B25B 17/00*** | (2006.01) |
| ***B25B 13/00*** | (2006.01) |
| ***B25B 13/04*** | (2006.01) |
| ***B25B 13/56*** | (2006.01) |

(52) U.S. Cl.

CPC ..... *B25B 13/04* (2013.01); *B25B 13/46* (2013.01); *B25B 13/463* (2013.01); *B25B 13/56* (2013.01)

(58) Field of Classification Search

CPC ..... B25B 13/04; B25B 13/06; B25B 13/56; B25B 13/46; B25B 13/463

USPC ..... 81/57.5, 124.4, 124.5

See application file for complete search history.

(56) References Cited

U.S. PATENT DOCUMENTS

| | | | | |
|---|---|---|---|---|
| 5,557,992 | A * | 9/1996 | Macor | B25B 13/56 81/124.4 |
| 6,220,123 | B1 * | 4/2001 | Chen | 81/63.2 |
| 7,047,844 | B1 * | 5/2006 | Macor | B25B 13/06 81/124.4 |
| D687,692 | S * | 8/2013 | Chen | D8/28 |
| 2005/0257649 | A1 * | 11/2005 | Chen | 81/60 |
| 2009/0038444 | A1 * | 2/2009 | Hu | 81/63.2 |
| 2011/0239827 | A1 * | 10/2011 | Hart | 81/60 |
| 2011/0296960 | A1 * | 12/2011 | Chen | 81/63 |

* cited by examiner

*Primary Examiner* — Bryan R Muller

(57) ABSTRACT

A wrench device with a plurality of driving holes includes a wrench body having two first through holes, each first through hole having an opening end and a positioning end which having two positioning grooves defined thereon, the two positioning grooves corresponding to each other, two actuating member having two driving holes and a positioning block, each driving hole having a first ratchet ring and a second ratchet ring, each positioning block passing through each corresponding first through hole, each positioning block having a positioning slice, a flexible assembly received into the positioning block. Under this arrangement, a user rotates the actuating member relative to the wrench body so as to change the driving hole, so that the user unlocks the screws with different size rapidly and easily.

4 Claims, 11 Drawing Sheets

WRENCH DEVICE WITH A PLURALITY OF DRIVING HOLES

BACKGROUND OF THE INVENTION

1. Field of the Invention

The present invention relates to a wrench, and more particularly to a wrench device with a plurality of driving holes.

2. Description of Related Art

A conventional wrench device comprises a wrench handle, at least one base is pivotally defined on at least one end of the wrench handle, a first ratchet member and a second ratchet member are received in the base, the first ratchet member having a plurality of first ratchet teeth and the second ratchet member having a plurality of second ratchet teeth, one side of the first ratchet member assembled to a first engaging block which has a plurality of first engaging teeth, one side of the second ratchet member assembled to a second engaging block which has a plurality of second engaging teeth, the first ratchet member and the second ratchet member engaging with the first engaging block and the second engaging block respectively, an operating bar pivotally defined between the first engaging block and the second engaging block, the operating bar having a first abutting member and a second abutting member which are respectively and elastically abutted against the first engaging block and the second engaging block, so that a rotating direction of the first ratchet member and another rotating direction of the second ratchet member is changed simultaneously because of the first abutting member, the second abutting member, the first engaging block and the second engaging block. Under this arrangement, a user operates the operating bar to change the direction of the ratchet member so as to lock a screw.

Another conventional wrench device comprises a wrench handle having a through hole opened at one end thereof, a ratchet member having a driving member extruded therefrom, the ratchet member assembled on the wrench handle, at least two actuating units respectively assembled to a bottom side and a top side of at least one end of the wrench handle, each actuating unit having a first sleeving hole and a second sleeving hole opened at two ends thereof respectively, each actuating unit having a sub through hole opened thereon so that the driving member passing through one actuating member, the ratchet member and another actuating member in order, the wrench handle having an engaging block pivotally defined thereon, the engaging block having two engaging portions defined at two ends thereof, the engaging block corresponding to the ratchet member. Under this arrangement, a user operates the engaging block so as to rotate the actuating unit; then, the user operates one of the two sleeving holes sleeving on a screw so as to unlock the screw.

However, the conventional wrench device has a disadvantage as following.

Under long time use, one end of the wrench handle will be deformed because of the operation of rotating the wrench handle relative to a screw, so that the base cannot be received within one end of the wrench handle anymore.

Moreover, another conventional wrench device has another disadvantage as following.

The actuating unit is rotated so as to change the sleeving hole because of the engaging block, the ratchet member and the driving member; however, a mechanism of said rotation is so complicated that the user cannot repair the mechanism of another conventional wrench device easily.

The present invention has arisen to mitigate and/or obviate the disadvantages of the conventional.

SUMMARY OF THE INVENTION

The main objective of the present invention is to provide a wrench device.

To achieve the objective, a wrench device with a plurality of driving holes comprises a wrench body and two actuating members;

the wrench body having two first through holes opened at two ends thereof, each first through hole comprising an opening end and a positioning end which is adjacent to and communicates with the opening end, two positioning grooves being defined at two inner lateral sides of the positioning end, the two positioning grooves corresponding to each other, each actuating member having two driving holes opened at two ends therethrough, each actuating member having a positioning block extruded at one side thereof, the positioning block being defined between the two driving holes, each driving hole having a first ratchet ring and a second ratchet ring received therein, one side of the first ratchet ring attached to another side of the second ratchet ring, each positioning block passing through each corresponding first through hole and being movable in each corresponding first through hole, each positioning block having a positioning slice defined at one end thereof, each positioning slice being opposite to each corresponding actuating member, a cross-sectional area of the positioning slice being larger than another cross-sectional area of the positioning block, the positioning block having an assembling groove opened at a lateral side thereof, the assembling groove corresponding to an inner wall of the first through hole, a flexible assembly received into the assembling groove, the flexible assembly being abutted against the two positioning grooves after the positioning block is moved to the positioning end of the first through hole. Wherein, one width of the positioning block and another width of the positioning slice are both smaller than one diameter of the opening end of the first through hole; another width of the positioning slice is larger than the other width of the positioning end; the flexible assembly comprises a positioning ball and a first elastomer; one end of the first elastomer abuts against a bottom of the assembling groove, and another end of the first elastomer abuts against the positioning ball so that the positioning ball is limited at an opening of the assembling groove; wherein when the positioning block is moved from the opening end of the first through hole to the positioning end of the first through hole, the positioning block is positioned in the positioning end because of the positioning ball and the first elastomer; the wrench body further has two sub through holes opened at two ends thereof; a distance is defined between each sub through hole and the positioning end of each corresponding first through hole; the two sub through holes communicate with the two driving holes respectively when the positioning block is positioned in the positioning end of the first through hole; the driving hole, the first ratchet ring and the second ratchet ring form as an integral part within the actuating member.

Under this arrangement, when the positioning block is located in the opening end of the first through hole, a user rotates the actuating member relative to the wrench body so as to change the driving hole, so that the user unlocks the screws with different size rapidly and easily.

A wrench device with a plurality of driving holes comprises a wrench body and two actuating members; the wrench body having two first through holes opened at two ends thereof, each first through hole comprising an opening end and a positioning end which is adjacent to and communicates with the opening end, two positioning grooves being defined at two inner lateral sides of the positioning end, the two positioning grooves corresponding to each other, each actuating member having two driving holes opened at two ends therethrough, each actuating member having a positioning block extruded at one side thereof, the positioning block being defined between the two driving holes, each driving hole having a first ratchet ring and a second ratchet ring received therein, one side of the first ratchet ring attached to another side of the second ratchet ring, each positioning block passing through each corresponding first through hole and being movable in each corresponding first through hole, each positioning block having a positioning slice defined at one end thereof, each positioning slice being opposite to each corresponding actuating member, a cross-sectional area of the positioning slice being larger than another cross-sectional area of the positioning block, the positioning block having an assembling groove opened at a lateral side thereof, the assembling groove corresponding to an inner wall of the first through hole, a flexible assembly received into the assembling groove, the flexible assembly being abutted against the two positioning grooves after the positioning block is moved to the positioning end of the first through hole, the actuating member having a receiving room opened therethrough, the receiving room being opposite to the positioning block, the receiving room having two ratchet member and an engaging assembly defined therein, the engaging assembly being defined between the two ratchet members, each ratchet member having a driving hole opened therethrough, each ratchet member having a plurality of ratchet teeth defined at an outer periphery thereof, the engaging assembly comprising two engaging blocks which correspond to the two ratchet member respectively, an operating bar which is defined between the two engaging blocks and two flexible units which are assembled between each corresponding engaging block and the operating bar, each engaging block having a plurality of engaging teeth defined at one side thereof, the engaging teeth corresponding to the ratchet member and engaging with the ratchet teeth of the ratchet member, each engaging block having a concaved portion defined at another side thereof, the operating bar having two sub assembling grooves defined at two sides thereof, each sub assembling groove corresponding to each corresponding concaved portion, one end of each flexible unit abutted against a bottom of each corresponding sub assembling groove, and another end of each flexible unit abutted against the concaved portion of each corresponding engaging block, each engaging block restricting a rotating direction of each corresponding ratchet member because of each corresponding flexible unit, the actuating member having a top cap defined at a top side thereof, the top cap covering the receiving room, the top cap having two second through holes opened thereon, each second through hole corresponding to each corresponding ratchet member and communicating with each corresponding driving hole, a switch unit and a plurality of threaded units being defined between the two second through holes, one of the threaded units passing through the switch unit and the top cap, and being locked on the operating bar, the top cap being locked on the actuating member by others of the threaded units so that the top cap covers the receiving room, so that the user operates the switch unit to control rotating directions of the two ratchet members simultaneously. Wherein, the actuating member has a base cap defined at a bottom side thereof; the base cap covers the bottom side of the actuating member; the positioning block is assembled on the base cap; the base cap has two third through holes opened therethrough; the two third through holes correspondingly communicate with the two driving holes.

Under this arrangement, when the positioning block is located in the opening end of the first through hole, a user rotates the actuating member relative to the wrench body so as to change the driving hole, so that the user unlocks the screws with different size rapidly and easily.

A wrench device with a plurality of driving holes comprises a wrench body and two actuating members; the wrench body having two first through holes opened at two ends thereof, each first through hole comprising an opening end and a positioning end which is adjacent to and communicates with the opening end, two positioning grooves being defined at two inner lateral sides of the positioning end, the two positioning grooves corresponding to each other, each actuating member having two driving holes opened at two ends therethrough, each actuating member having a positioning block extruded at one side thereof, the positioning block being defined between the two driving holes, each driving hole having a first ratchet ring and a second ratchet ring received therein, one side of the first ratchet ring attached to another side of the second ratchet ring, each positioning block passing through each corresponding first through hole and being movable in each corresponding first through hole, each positioning block having a positioning slice defined at one end thereof, each positioning slice being opposite to each corresponding actuating member, a cross-sectional area of the positioning slice being larger than another cross-sectional area of the positioning block, the positioning block having an assembling groove opened at a lateral side thereof, the assembling groove corresponding to an inner wall of the first through hole, a flexible assembly received into the assembling groove, the flexible assembly being abutted against the two positioning grooves after the positioning block is moved to the positioning end of the first through hole, the actuating member having a first receiving space and a second receiving space opened therethrough, a distance being defined between the first receiving space and the second receiving space, two ratchet members being defined in the first receiving space and the second receiving space respectively, each ratchet member having a plurality of ratchet teeth defined at an outer periphery thereof, each ratchet member having a driving hole opened therethrough, two engaging assemblies being defined in the first receiving space and the second receiving space respectively, each engaging assembly comprising an engaging block which corresponds to each corresponding ratchet member, an operating bar and a flexible unit which is assembled between each corresponding engaging block and operating bar, each engaging block having a plurality of engaging teeth defined at one side thereof, the engaging teeth corresponding to the ratchet member and engaging with the ratchet teeth of the ratchet member, each engaging block having a concaved portion defined at another side thereof, each operating bar having a sub assembling groove defined at one sides thereof, each sub assembling groove corresponding to each corresponding concaved portion, one end of each flexible unit abutted against a bottom of each corresponding sub assembling groove, and another end of each flexible unit abutted against the concaved portion of each corresponding engaging block, each engaging block restricting a rotating direction of each corresponding ratchet member because of each corresponding flexible unit, the actuating member having a top cap defined at a top side thereof, the top cap covering the first receiving space and the second receiving space, the top cap having two second through holes opened thereon, each second through hole corresponding to each corresponding ratchet member and communicating with each corresponding driving hole, the two second through holes communicating with the first receiving space and the second receiving space respectively, two switch units and a plurality of threaded units being defined between the two second through holes, two of the threaded units passing through the two switch units and the top cap, and being locked on the operating bars within the first receiving space and the second receiving space respectively, the top cap being locked on the actuating member by others of the threaded units so that the top cap covers the first receiving space and the second receiving space, so that the user operates the two switch units to control rotating directions of the two ratchet members respectively. Wherein, the actuating member has a base cap defined at a bottom side thereof; the base cap covers the bottom side of the actuating member; the positioning block is assembled on the base cap; the base cap has two third through holes opened therethrough; the two third through holes correspondingly communicate with the two driving holes.

Under this arrangement, when the positioning block is located in the opening end of the first through hole, a user rotates the actuating member relative to the wrench body so as to change the driving hole, so that the user unlocks the screws with different size rapidly and easily.

A wrench device with a plurality of driving holes comprises a wrench body and two actuating members; the wrench body having two first through holes opened at two ends thereof, each first through hole comprising an opening end and a positioning end which is adjacent to and communicates with the opening end, two positioning grooves being defined at two inner lateral sides of the positioning end, the two positioning grooves corresponding to each other, each actuating member having two driving holes opened at two ends therethrough, each actuating member having a positioning block extruded at one side thereof, the positioning block being defined between the two driving holes, each driving hole having a first ratchet ring and a second ratchet ring received therein, one side of the first ratchet ring attached to another side of the second ratchet ring, each positioning block passing through each corresponding first through hole and being movable in each corresponding first through hole, each positioning block having a positioning slice defined at one end thereof, each positioning slice being opposite to each corresponding actuating member, a cross-sectional area of the positioning slice being larger than another cross-sectional area of the positioning block, the positioning block having an assembling groove opened at a lateral side thereof, the assembling groove corresponding to an inner wall of the first through hole, a flexible assembly received into the assembling groove, the flexible assembly being abutted against the two positioning grooves after the positioning block is moved to the positioning end of the first through hole, the actuating member having a first receiving space and a second receiving space opened therethrough, a distance being defined between the first receiving space and the second receiving space, two ratchet members being defined in the first receiving space and the second receiving space respectively, each ratchet member having a plurality of ratchet teeth defined at an outer periphery thereof, each ratchet member having a driving hole opened therethrough, each ratchet member having a ratch plate assembled thereon, each ratchet member having a sleeving portion extended at a top side therefrom, the sleeving portion being adjacent to the ratchet teeth, the ratch plate comprising an upper ratch unit and a lower ratch unit, the upper ratch unit connecting to the lower ratch unit, a plurality of upper ratch teeth being defined on a top face of the upper ratch unit, a plurality of lower ratch teeth being defined around an outer periphery of the lower ratch unit, the ratch plate having a sleeving hole opened therethrough, the ratch plate sleeving on the sleeving portion of the ratchet member via the sleeving hole, two engaging assemblies being defined in the first receiving space and the second receiving space so as to control the two ratch plates and the two ratchet members respectively, each engaging assembly comprising an engaging block which corresponds to each corresponding ratchet member, and a flexible unit which is assembled between each corresponding engaging block and one of an inner wall of the two receiving spaces, each engaging block having a plurality of lower engaging teeth and a plurality of upper engaging teeth defined at one side thereof, the lower engaging teeth corresponding to the ratchet member and engaging with the ratchet teeth of the ratchet member, the upper engaging teeth engaging with the lower ratch teeth of the lower ratch unit of the ratch plate, the upper engaging teeth being attached to the lower engaging teeth, each engaging block having a positioning protrusion extruded at another side therefrom, the first receiving space and the second receiving space having a first sleeving groove and a second sleeving groove defined at two inner walls thereof respectively, the two flexible units being assembled into the first sleeving groove and the second sleeving groove respectively, one end of one flexible unit and one end of another flexible unit abutted against a bottom of the first sleeving groove and a bottom of the second sleeving groove respectively, another end of one flexible unit and another end of another flexible unit selectively abutted against one of two sides of one positioning protrusion and one of two sides of another positioning protrusion respectively. Wherein, the actuating member has a base cap defined at a bottom side thereof; the base cap covers the bottom side of the actuating member; the positioning block is assembled on the base cap; the base cap has two third through holes opened therethrough; the two third through holes correspondingly communicate with the two driving holes.

Under this arrangement, when the user rotates the ratch plate, the lower ratch unit of the ratch plate engages with the upper engaging teeth of the engaging block and the flexible unit is selectively abutted against one of the two sides of the positioning protrusion; thereby, the engaging block is engaged with the ratch plate and the ratchet member and is abutted against the flexible unit; as a result, the engaging block restricts a rotating direction of the ratchet member. Therefore, when the positioning block is located in the opening end of the first through hole, a user rotates the actuating member relative to the wrench body so as to change the driving hole, so that the user unlocks the screws with different size rapidly and easily.

Further benefits and advantages of the present invention will become apparent after a careful reading of the detailed description with appropriate reference to the accompanying drawings.

DETAILED DESCRIPTION OF THE INVENTION

Figure 1:
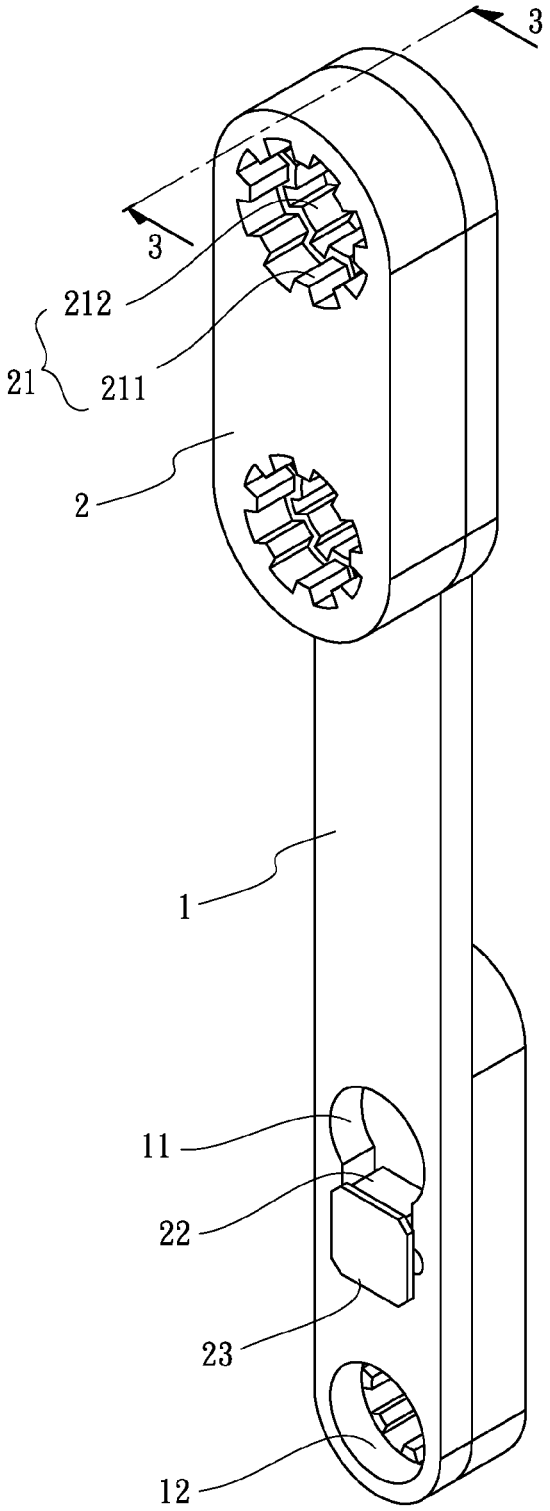
FIG. 1 is a perspective view of a first embodiment of a wrench device with a plurality of driving holes of the present invention.
Figure 2:
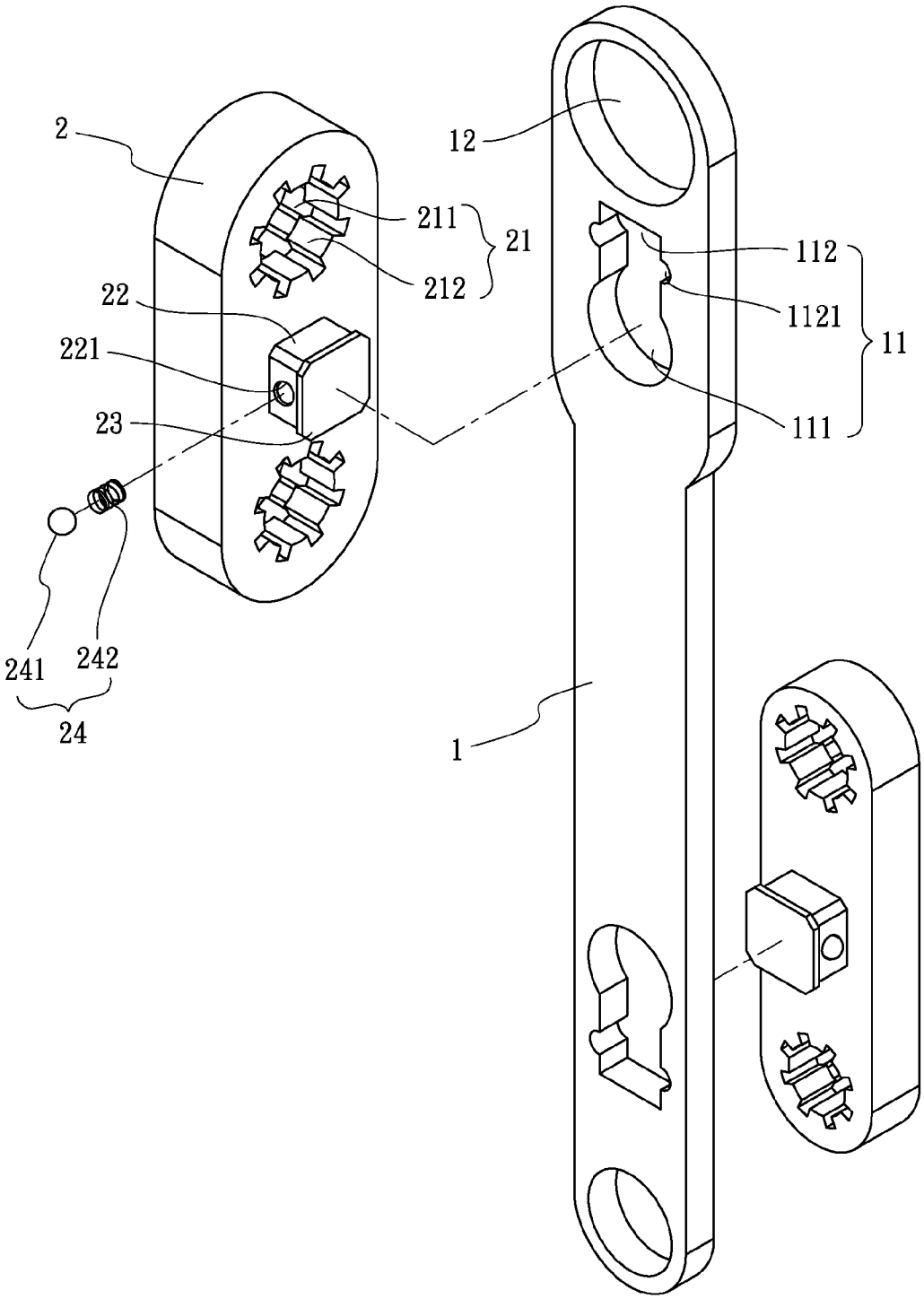
FIG. 2 is an exploded perspective view of the first embodiment of the present invention.
Figure 3:
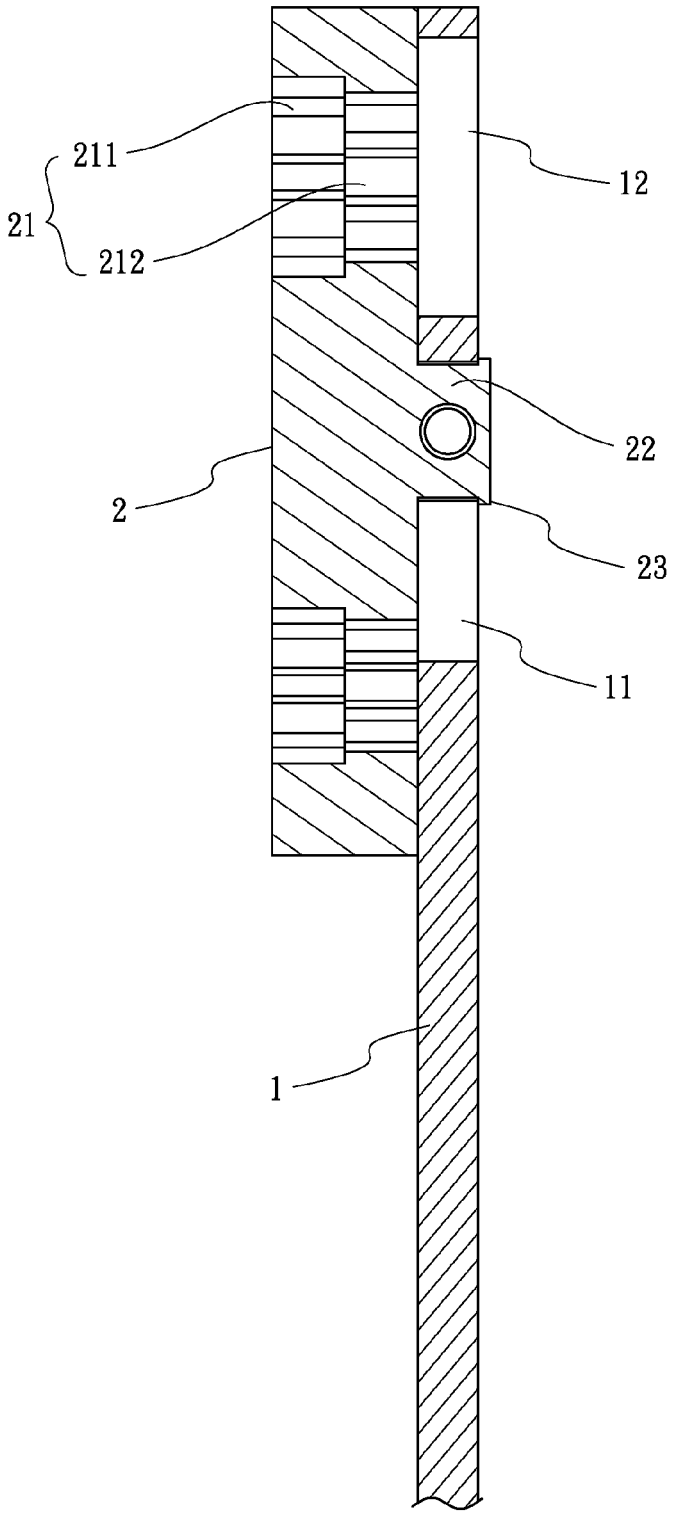
FIG. 3 is a partial cross-sectional view along line 3-3 in FIG. 1.

Referring to FIGS. 1-3, a wrench device with a plurality of driving holes in accordance with a first embodiment of the present invention comprises a wrench body 1 and two actuating members 2.

The wrench body 1 has two first through holes 11 opened at two ends thereof. Each first through hole 11 comprises an opening end 111 and a positioning end 112 which is adjacent to and communicates with the opening end 111. Two positioning grooves 1121 are defined at two inner lateral sides of the positioning end 112. The two positioning grooves 1121 correspond to each other.

Each actuating member 2 has two driving holes 21 opened at two ends therethrough. Each actuating member 2 has a positioning block 22 extruded at one side thereof. The positioning block 22 is defined between the two driving holes 21. Each driving hole 21 has a first ratchet ring 211 and a second ratchet ring 212 received therein. One side of the first ratchet ring 211 is attached to another side of the second ratchet ring 212. Each positioning block 22 passes through each corresponding first through hole 11 and is movable in each corresponding first through hole 11. Each positioning block 22 has a positioning slice 23 defined at one end thereof. Each positioning slice 23 is opposite to each corresponding actuating member 2. A cross-sectional area of the positioning slice 23 is larger than another cross-sectional area of the positioning block 22. The positioning block 22 has an assembling groove 221 opened at a lateral side thereof. The assembling groove 221 corresponds to an inner wall of the first through hole 11. A flexible assembly 24 is received into the assembling groove 221. After the positioning block 22 is moved to the positioning end 112 of the first through hole 11, the flexible assembly 24 is abutted against the two positioning grooves 1121.

Under this arrangement, when the positioning block 22 is located in the opening end 111 of the first through hole 11, a user rotates the actuating member 2 relative to the wrench body 1 so as to change the driving hole 21, so that the user unlocks the screws with different size rapidly and easily.

Referring to FIG. 2, the flexible assembly 24 comprises a positioning ball 241 and a first elastomer 242. One end of the first elastomer 242 abuts against a bottom of the assembling groove 221, and another end of the first elastomer 242 abuts against the positioning ball 241 so that the positioning ball 241 is limited at an opening (not numbered) of the assembling groove 221. Therefore, when the positioning block 22 is moved from the opening end 111 of the first through hole 11 to the positioning end 112 of the first through hole 11, the positioning block 22 is positioned in the positioning end 112 because of the positioning ball 241 and the first elastomer 242.

Figure 4:
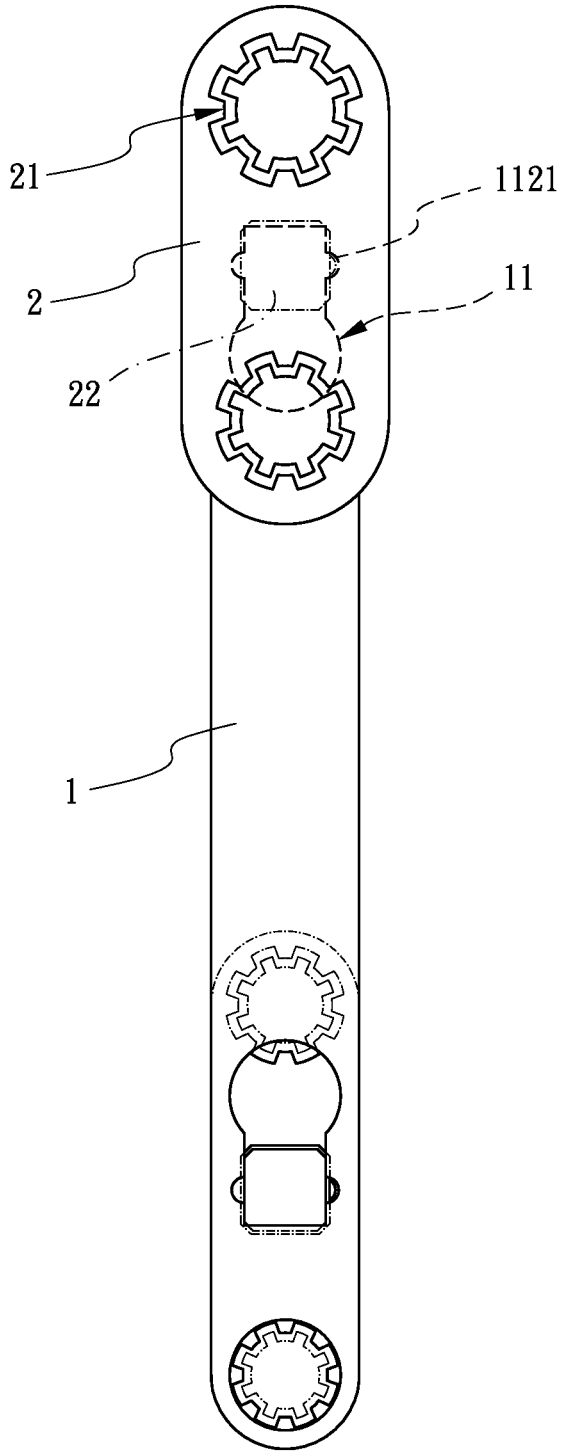
FIG. 4 is a schematic view of the first embodiment of the present invention for showing an actuating member is not rotated relative to a wrench body so that a positioning slice of the actuating member is located in a positioning end of the wrench body.
Figure 5:
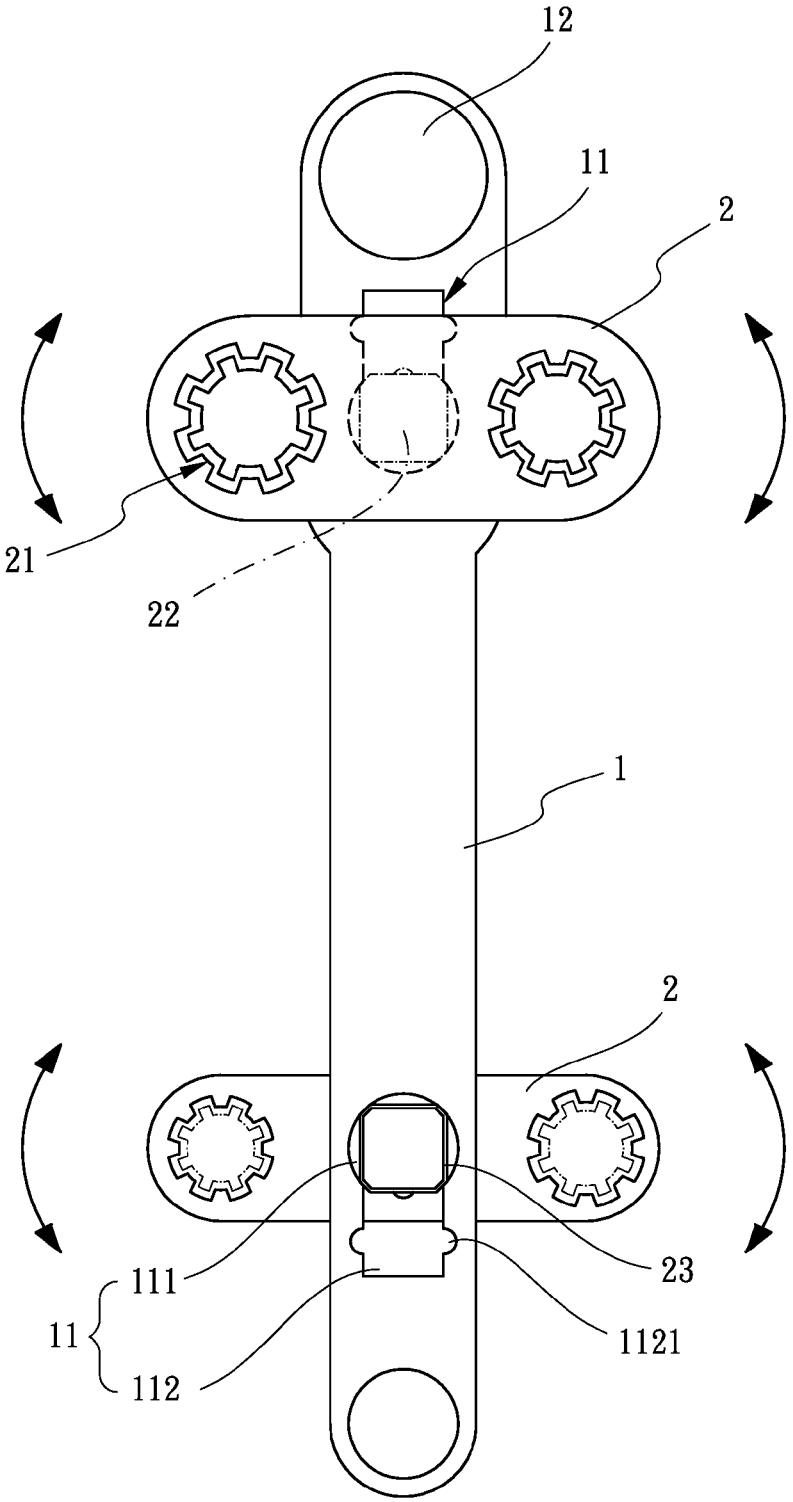
FIG. 5 is a schematic view of the first embodiment of the present invention for showing the actuating member is rotated relative to the wrench body so that the positioning slice of the actuating member is located in an opening end of the wrench body.

Referring to FIGS. 4-5, when the user wants to change one driving hole 21 to another driving hole 21, the user pushes the actuating member 2 toward a direction of another actuating member 2 firstly; meanwhile, the positioning ball 241 is not abutted against one of the two positioning grooves 1211 and the positioning ball 241 is forced by an inner wall of the positioning end 112 so that the positioning ball 241 compresses the first elastomer 242 toward the assembling groove 221; as a result, the positioning block 22 is moved from the positioning end 112 of the first through hole 11 toward the opening end 111 of the first through hole 11; besides, since one width of the positioning block 22 is smaller the one diameter of the opening end 111, the positioning block 22 is rotatable in the opening end 111. Therefore, the user rotates the actuating member 2 relative to the wrench body 1 so as to change one driving hole 21 to another driving hole 21.

After the user changes one driving hole 21 with another driving hole 21, the user pushes the actuating member 2 from the direction of another actuating member 2 firstly; meanwhile, the positioning ball 241 is forced by the inner wall of the positioning end 112 so that the positioning ball 241 compresses the first elastomer 242 toward the assembling groove 221 to generate a recovering force; as a result, the positioning block 22 is moved from the opening end 111 of the first through hole 11 toward the positioning end 112 of the first through hole 11, and the positioning ball 241 is abutted against another one of the two positioning grooves 1121 because of the recovering force. Therefore, the positioning block 22 is positioned in the positioning end 112 of the first through hole 11 so that the actuating member 2 is fastened on the wrench body 1.

Referring to FIG. 1, within the actuating member 2, the driving hole 21, the first ratchet ring 211 and the second ratchet ring 212 form as an integral part.

Referring to FIG. 2, one width of the positioning block 22 and another width of the positioning slice 23 are both smaller than one diameter of the opening end 111 of the first through hole 11. Therefore, when the positioning block 22 is moved from the positioning end 112 to the opening end 111, the user departs the actuating member 2 from the wrench body 1 so as to replace a further actuating member 2. Moreover, another width of the positioning slice 23 is larger than the other width of the positioning end 112. Therefore, when the positioning block 22 is within the positioning end 112, the wrench body 1 is sandwiched between the positioning slice 23 and the actuating member 2. In addition, the positioning slice 23 is attached to a bottom plane of the wrench body 1 where the actuating member 2 is assembled to a top plane of the wrench body 1, so that the actuating member 2 does not depart from the positioning end 112 easily when the user operates (Methods for preventing the actuating member 2 departing from the positioning end 112 of the first through hole 11 is not limited in the present invention; a diameter of each corresponding first ratchet ring 211 is not equal to another diameter of each corresponding second ratchet ring 212 in each driving hole 21.).

Referring to FIG. 2, the wrench body 1 further has two sub through holes 12 opened at two ends thereof. A distance is defined between each sub through hole 12 and the positioning end 112 of each corresponding first through hole 11. The two sub through holes 12 communicate with the two driving holes 21 respectively when the positioning block 22 is positioned in the positioning end 112 of the first through hole 11. Therefore, the user operates the driving hole 21 of the actuating member 2 enclosing a screw (not shown) directly so that the user selectively unlocks and locks the screw; moreover, the user operates the screw passing through the sub through hole 12 of the wrench body 1 and inserts the screw into the driving hole 21 so as to unlock and lock the screw selectively.

Figure 6:
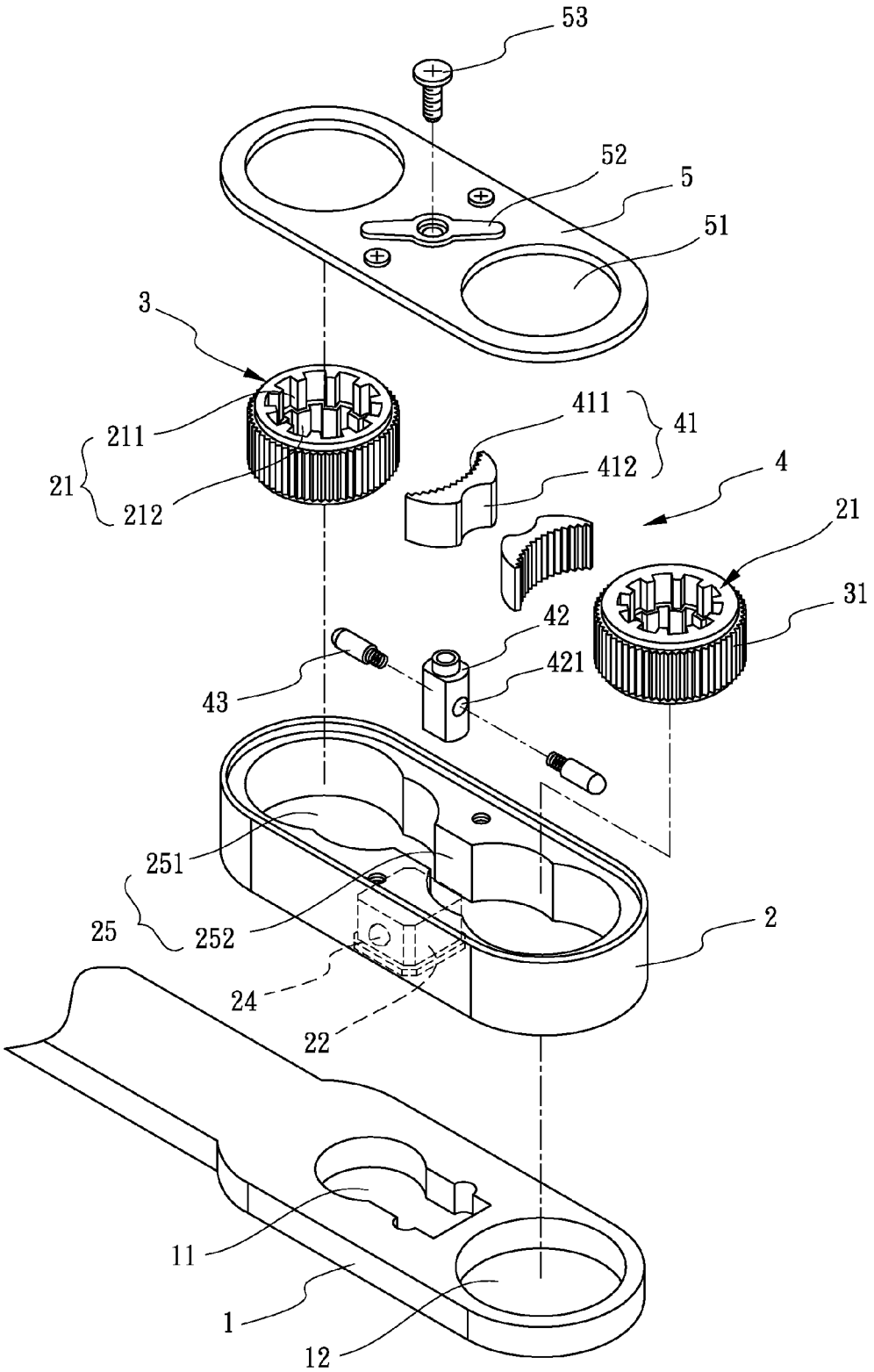
FIG. 6 is an exploded perspective view of a second embodiment of the present invention.

Referring to FIG. 6, which shows a second embodiment of the wrench device with a plurality of driving holes in accordance with the present invention (Only the differences between the first embodiment and the second embodiment are further described.). The actuating member 2 has a receiving room 25 opened therethrough. The receiving room 25 is opposite to the positioning block 22. The receiving room has two end portions 251 defined at two ends thereof and a neck portion 252 defined between the two end portions. The two end portions 251 communicate with each other via the neck portion 252. Each end portion 251 has a ratchet member 3 defined therein. Each ratchet member 3 has a plurality of ratchet teeth 31 defined at an outer periphery thereof. Each ratchet member 3 has a driving hole 21 opened therethrough. Each driving hole 21 has a first ratchet ring 211 and a second ratchet ring 212 received therein. The ratchet member 3, the driving hole 21, the first ratchet ring 211 and the second ratchet ring 212 form as an integral part.

An engaging assembly 4 is defined between the two ratchet members 3. The engaging assembly 4 comprises two engaging blocks 41 which correspond to the two ratchet member 3 respectively, an operating bar 42 which is defined between the two engaging blocks 41, and two flexible units 43 which are assembled between each corresponding engaging block 41 and the operating bar 42. Each engaging block 41 has a plurality of engaging teeth 411 defined at one side thereof. The engaging teeth 411 correspond to the ratchet member 3 and engage with the ratchet teeth 31 of the ratchet member 3. Each engaging block 41 has a concaved portion 412 defined at another side thereof. The operating bar 42 is assembled into the neck portion 252 of the receiving room 25. The operating bar 42 has two sub assembling grooves 421 defined at two sides thereof. Each sub assembling groove 421 corresponds to each corresponding concaved portion 412. The two flexible units 43 are assembled into the two sub assembling groove 421 respectively. One end of each flexible unit 43 is abutted against a bottom of each corresponding sub assembling groove 421, and another end of each flexible unit 43 is abutted against the concaved portion 412 of each corresponding engaging block 41. Therefore, each engaging block 41 restricts a rotating direction of each corresponding ratchet member 3 because of each corresponding flexible unit 43.

The actuating member 2 has a top cap 5 defined at a top side thereof. The top cap 5 covers the receiving room 25. The top cap 5 has two second through holes 51 opened thereon. Each second through hole 51 corresponds to each corresponding ratchet member 3 and communicates with each corresponding driving hole 21. The top cap 5 has a switch unit 52 defined at a top side thereof. The switch unit 52 is defined between the two second through holes 51. The top cap has a plurality of threaded units 53 defined thereon. One of the threaded units 53 passes through the switch unit 52 and the top cap 5, and is locked on the operating bar 42. The top cap 5 is locked on the actuating member 2 by others of the threaded units 53 so that the top cap 5 covers the receiving room 25. Therefore, the user operates the switch unit 52 to control rotating directions of the two ratchet members 3 simultaneously.

Figure 8:
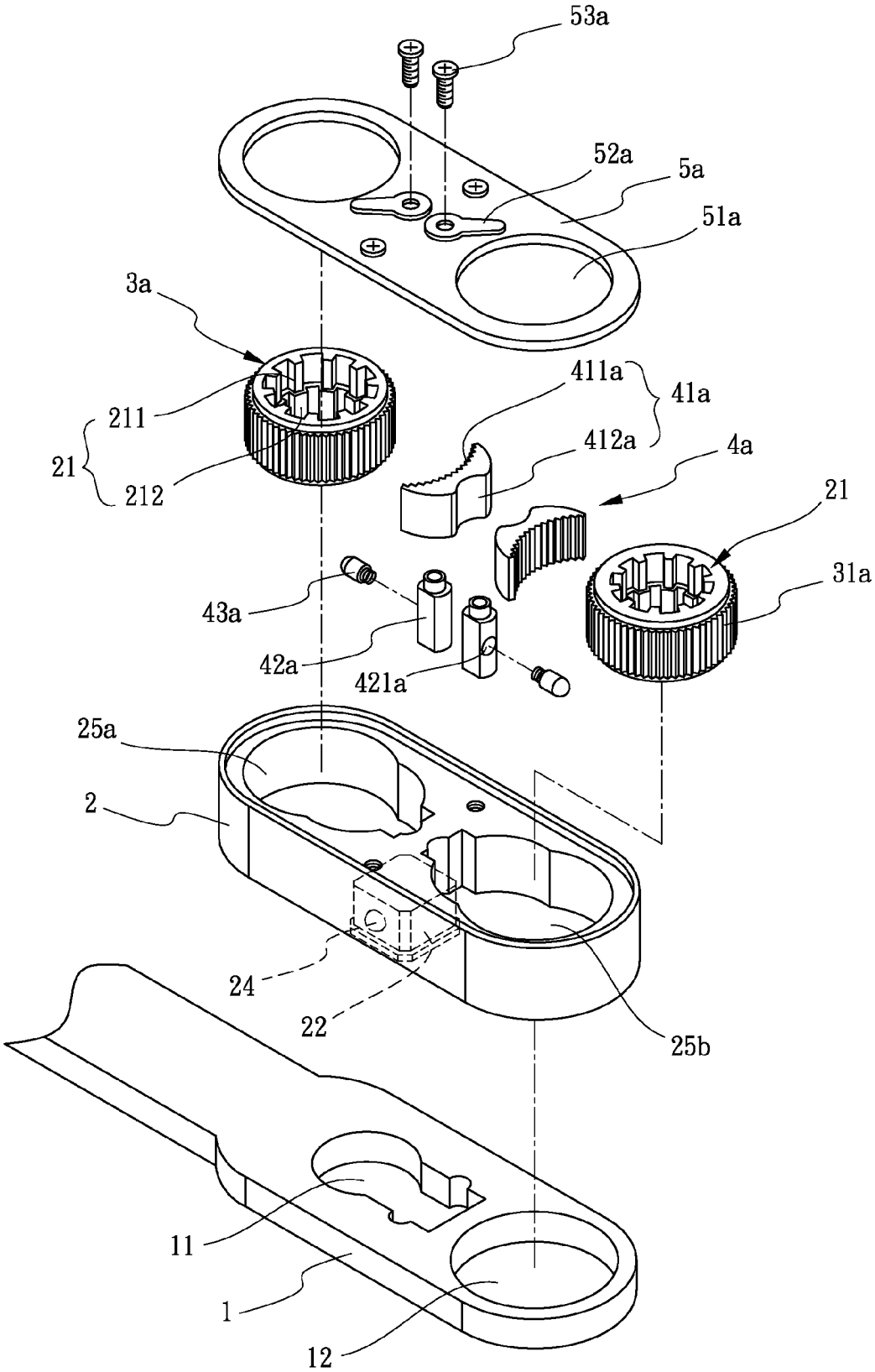
FIG. 8 is an exploded perspective view of a third embodiment of the present invention.

Referring to FIG. 8, which shows a third embodiment of the wrench device with a plurality of driving holes in accordance with the present invention (Only the differences between the first embodiment and the third embodiment are further described.). The actuating member 2 has a first receiving space 25*a* and a second receiving space 25*b* opened therethrough. A distance is defined between the first receiving space 25*a* and the second receiving space 25*b*. A diameter of the first receiving space 25*a* is reduced gradually from one side thereof toward another side thereof. Another diameter of the second receiving space 25*b* is reduced gradually from one side thereof toward another side thereof. Two ratchet members 3*a* are defined in the first receiving space 25*a* and the second receiving space 25*b* respectively. Each ratchet member 3*a* has a plurality of ratchet teeth 31*a* defined at an outer periphery thereof. Each ratchet member 3*a* has a driving hole 21 opened therethrough. Each driving hole 21 has a first ratchet ring 211 and a second ratchet ring 212 received therein. The ratchet member 3*a*, the driving hole 21, the first ratchet ring 211 and the second ratchet ring 212 form as an integral part.

Two engaging assemblies 4*a* are defined in the first receiving space 25*a* and the second receiving space 25*b* respectively. Each engaging assembly 4*a* comprises an engaging block 41*a* which corresponds to each corresponding ratchet member 3*a*, an operating bar 42*a* and a flexible unit 43*a* which is assembled between each corresponding engaging block 41*a* and operating bar 42*a*. Each engaging block 41*a* has a plurality of engaging teeth 411*a* defined at one side thereof. The engaging teeth 411*a* correspond to the ratchet member 3*a* and engage with the ratchet teeth 31*a* of the ratchet member 3*a*. Each engaging block 41*a* has a concaved portion 412*a* defined at another side thereof. Each operating bar 42*a* has a sub assembling groove 421*a* defined at one sides thereof. Each sub assembling groove 421*a* corresponds to each corresponding concaved portion 412*a*. Each flexible unit 43*a* is assembled into each corresponding sub assembling groove 421*a*. One end of each flexible unit 43*a* is abutted against a bottom of each corresponding sub assembling groove 421*a*, and another end of each flexible unit 43*a* is abutted against the concaved portion 412*a* of each corresponding engaging block 41*a*. Therefore, each engaging block 41*a* restricts a rotating direction of each corresponding ratchet member 3*a* because of each corresponding flexible unit 43*a*.

The actuating member 2 has a top cap 5*a* defined at a top side thereof. The top cap 5*a* covers the first receiving space 25*a* and the second receiving space 25*b*. The top cap 5*a* has two second through holes 51*a* opened thereon. Each second through hole 51*a* corresponds to each corresponding ratchet member 3*a* and communicates with each corresponding driving hole 21. The two second through holes 51*a* communicate with the first receiving space 25*a* and the second receiving space 25*b* respectively. The top cap 5*a* has two switch units 52*a* defined at a top side thereof. The two switch units 52*a* are defined between the two second through holes 51*a*. The top cap 5*a* has a plurality of threaded units 53*a* defined thereon. Two of the threaded units 53*a* pass through the two switch units 52*a* and the top cap 5*a*, and are locked on the operating bars 42*a* within the first receiving space 25*a* and the second receiving space 25*b* respectively. The top cap 5*a* is locked on the actuating member 2 by others of the threaded units 53*a* so that the top cap 5*a* covers the first receiving space 25*a* and the second receiving space 25*b*. Therefore, the user operates the two switch units 52*a* to control rotating directions of the two ratchet members 3*a* respectively.

Figure 10:
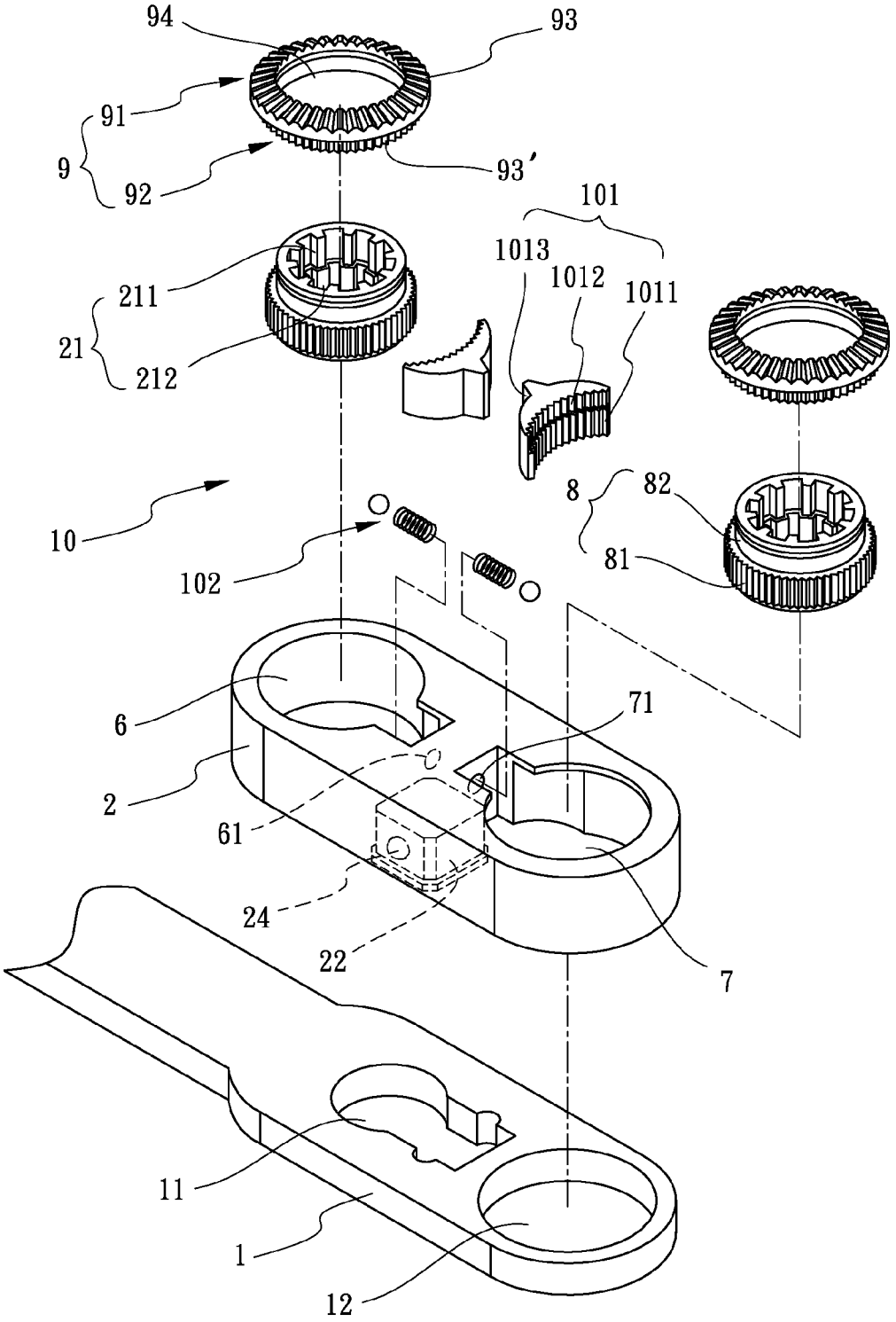
FIG. 10 is an exploded perspective view of a fourth embodiment of the present invention.

Referring to FIG. 10, which shows a fourth embodiment of the wrench device with a plurality of driving holes in accordance with the present invention (Only the differences between the first embodiment and the fourth embodiment are further described.). The actuating member 2 has a first receiving space 6 and a second receiving space 7 opened therethrough. A distance is defined between the first receiving space 6 and the second receiving space 7. A diameter of the first receiving space 6 is reduced gradually from one side thereof toward another side thereof. Another diameter of the second receiving space 7 is reduced gradually from one side thereof toward another side thereof. Two ratchet members 8 are defined in the first receiving space 6 and the second receiving space 7 respectively. Each ratchet member 8 has a plurality of ratchet teeth 81 defined at an outer periphery thereof. Each ratchet member 8 has a driving hole 21 opened therethrough.

Each ratchet member 8 has a ratch plate 9 assembled thereon. Each ratchet member 8 has a sleeving portion 82 extended at a top side therefrom. The sleeving portion 82 is adjacent to the ratchet teeth 81. The sleeving portion 82 corresponds to the ratch plate 9. The ratch plate 9 comprises an upper ratch unit 91 and a lower ratch unit 92. The upper ratch unit 91 connects to the lower ratch unit 92. A plurality of upper ratch teeth 93 is defined on a top face of the upper ratch unit 91. A plurality of lower ratch teeth 93' is defined around an outer periphery of the lower ratch unit 92. The ratch plate 9 has a sleeving hole 94 opened therethrough. The ratch plate 9 sleeves on the sleeving portion 82 of the ratchet member 8 via the sleeving hole 94.

Two engaging assemblies 10 are defined in the first receiving space 6 and the second receiving space 7 so as to control the two ratch plates 9 and the two ratchet members 8 respectively. Each engaging assembly 10 comprises an engaging block 101 which corresponds to each corresponding ratchet member 8, and a flexible unit 102 which is assembled between each corresponding engaging block 101 and one of an inner wall of the two receiving spaces 7, 8. Each engaging block 101 has a plurality of lower engaging teeth 1011 and a plurality of upper engaging teeth 1012 defined at one side thereof. The lower engaging teeth 1011 correspond to the ratchet member 8 and engage with the ratchet teeth 81 of the ratchet member 8. The upper engaging teeth 1012 engage with the lower ratch teeth 93' of the lower ratch unit 92 of the ratch plate 9. The upper engaging teeth 1012 are attached to the lower engaging teeth 1011. Each engaging block 101 has a positioning protrusion 1013 extruded at another side therefrom. The first receiving space 6 and the second receiving space 7 have a first sleeving groove 61 and a second sleeving groove 71 defined at two inner walls thereof respectively. The two flexible units 102 are assembled into the first sleeving groove 61 and the second sleeving groove 71 respectively. One end of one flexible unit 102 and one end of another flexible unit 102 are abutted against a bottom of the first sleeving groove 61 and a bottom of the second sleeving groove 71 respectively. Another end of one flexible unit 102 and another end of another flexible unit 102 are selectively abutted against one of two sides of one positioning protrusion 1013 and one of two sides of another positioning protrusion 1013 respectively.

Under this arrangement, when the user rotates the ratch plate 9, the lower ratch unit 92 of the ratch plate 9 engages with the upper engaging teeth 1012 of the engaging block 101 and the flexible unit 102 is selectively abutted against one of the two sides of the positioning protrusion 1013; thereby, the engaging block 101 is engaged with the ratch plate 9 and the ratchet member 8 and is abutted against the flexible unit 102; as a result, the engaging block 101 restricts a rotating direction of the ratchet member 8.

Figure 7:
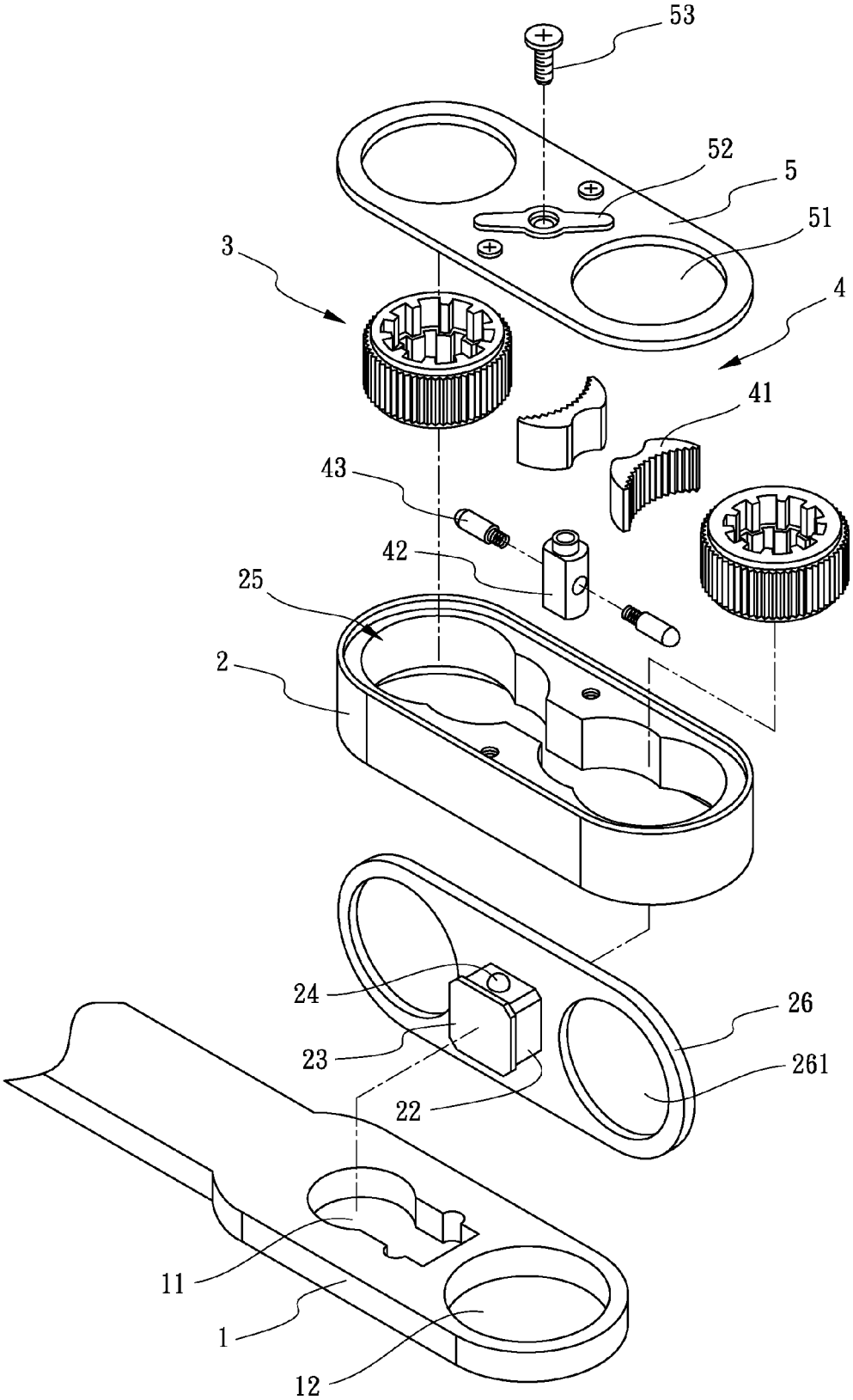
FIG. 7 is another exploded perspective view of the second embodiment of the present invention for showing an actuating member has a base cap defined at a bottom thereof.
Figure 9:
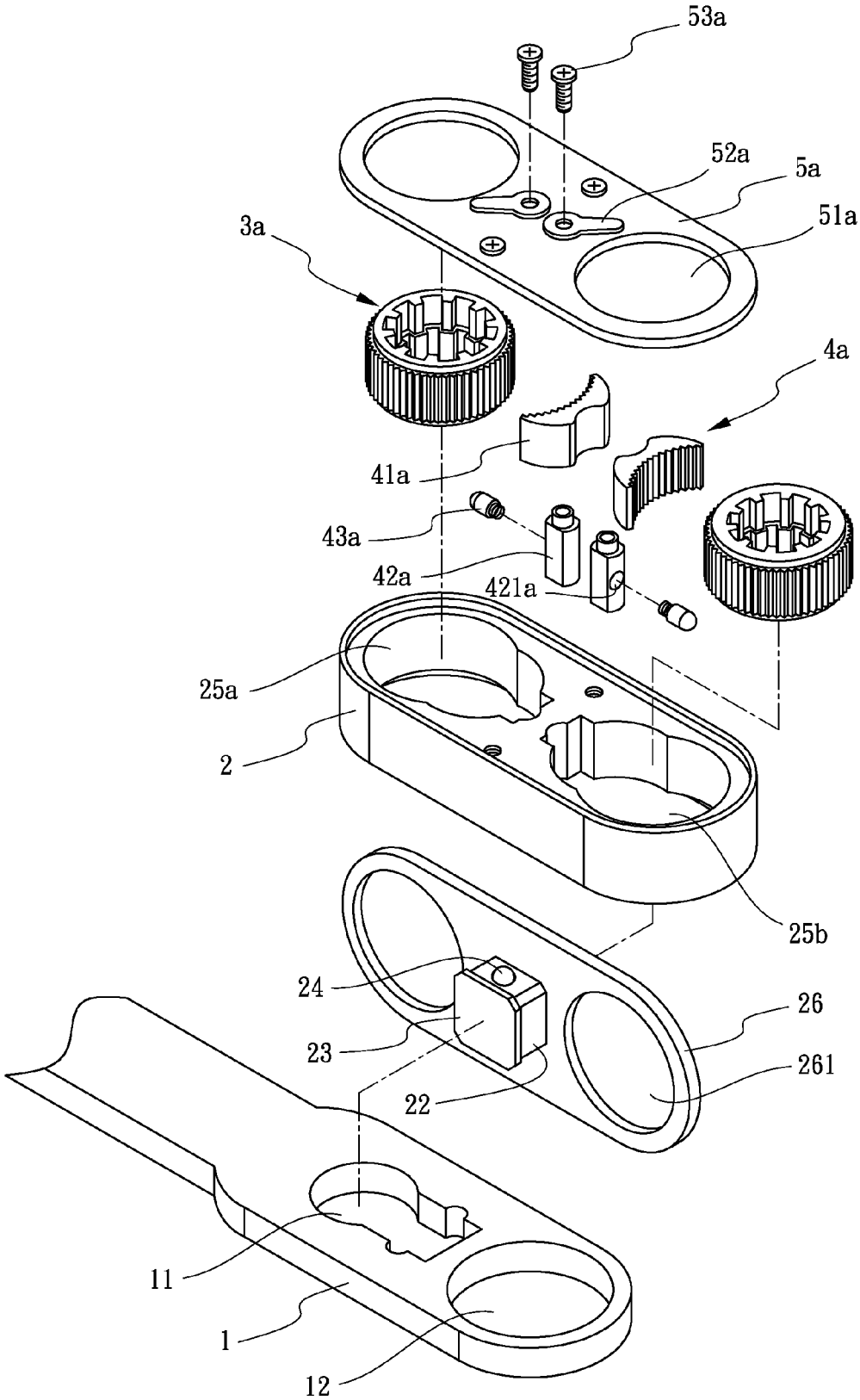
FIG. 9 is another exploded perspective view of the third embodiment of the present invention for showing an actuating member has a base cap defined at a bottom thereof.
Figure 11:
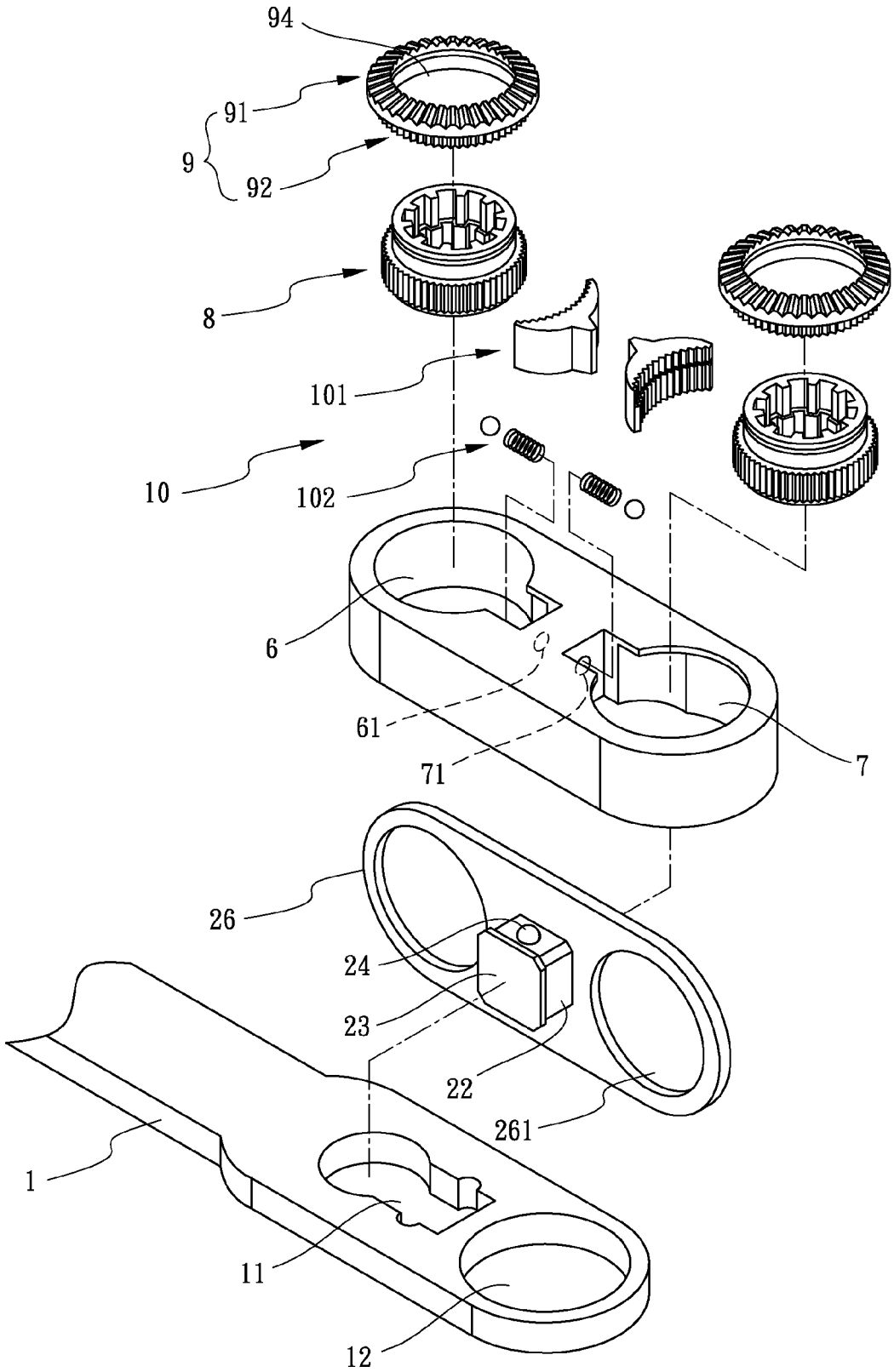
FIG. 11 is another exploded perspective view of the fourth embodiment of the present invention for showing an actuating member has a base cap defined at a bottom thereof.

According to the descriptions about the second embodiment, the third embodiment and the fourth embodiment of the present invention and referring to FIG. 7, FIG. 9 and FIG. 11, the actuating member 2 has a base cap 26 defined at a bottom side thereof. The base cap 26 covers the bottom side of the actuating member 2. The positioning block 22 is assembled on the base cap 26. The top cap 5, 5*a* and the base cap 26 cover the actuating member 2 for preventing the ratchet member 3, 3*a* and the engaging assembly 4; 4*a* departing from the actuating member 2. The base cap 26 has two third through holes 261 opened therethrough. The two third through holes 261 correspondingly communicate with the two driving holes 21. The two third through holes 261 communicate with the two sub through holes 12 respectively when the positioning block 22 is positioned in the positioning end 112 of the first through hole 11.

Although the invention has been explained in relation to its preferred embodiment, it is to be understood that many other possible modifications and variations can be made without departing from the spirit and scope of the invention as hereinafter claimed.

What is claimed is:

1. A wrench device with a plurality of driving holes comprising:

a wrench body and two actuating members;

the wrench body having two first through holes opened at two ends thereof, each first through hole comprising an opening end and a positioning end which is adjacent to and communicates with the opening end, two positioning grooves being defined at two inner lateral sides of the positioning end, the two positioning grooves corresponding to each other; and each of the actuating members having a first receiving space and a second receiving space opened therethrough; a distance defined between the first receiving space and the second receiving space; two ratchet members received in the first receiving space and the second receiving space respectively; each ratchet member having a plurality of ratchet teeth defined at an outer periphery thereof; the two ratchet members each have a driving hole defined therethrough;

each ratchet member having a ratchet plate assembled thereon; each ratchet member having a sleeving portion extended at a top side therefrom; the sleeving portion being adjacent to the ratchet teeth; the ratchet plate comprising an upper ratchet unit and a lower ratchet unit; a plurality of upper ratchet teeth is defined on a top face of the upper ratchet unit; a plurality of lower ratchet teeth defined around an outer periphery of the lower ratchet unit; the ratchet plate having a sleeving hole opened therethrough; the ratchet plate sleeving on the sleeving portion of the ratchet member via the sleeving hole;

two engaging assemblies located in the first receiving space and the second receiving space so as to control the two ratchet plates and the two ratchet members respectively; each engaging assembly comprising an engaging block which corresponds to each corresponding ratchet member, and a flexible unit which is assembled between each corresponding engaging block and one of an inner wall of the two receiving spaces; each engaging block having a plurality of lower engaging teeth and a plurality of upper engaging teeth defined at one side thereof, the lower engaging teeth located corresponding to the ratchet member and engaged with the ratchet teeth of the ratchet member; the upper engaging teeth engaged with the lower ratchet teeth of the lower ratchet unit of the ratchet plate; the upper engaging teeth attached to the lower engaging teeth; the first receiving space and the second receiving space having a first sleeving groove and a second sleeving groove defined at two inner walls thereof respectively; the two flexible units being assembled into the first sleeving groove and the second sleeving groove respectively; one end of one flexible unit and one end of the other flexible unit being butted against a bottom of the first sleeving groove and a bottom of the second sleeving groove respectively; the other end of the two flexible units being in contact with the other side that is opposite to the upper and lower engaging teeth on the engaging block corresponding thereto;

wherein when a user rotates the ratchet plate, the lower ratchet unit of the ratchet plate is engaged with the upper engaging teeth of the engaging block, the flexible unit is selectively abutted against the other side that is opposite to the upper and lower engaging teeth on the engaging block, thereby, the engaging block is engaged with the ratchet plate and the ratchet member and is abutted against the flexible unit; as a result, the engaging block restricts a rotating direction of the ratchet member;

each of the actuating members having a base cap connected to a bottom side thereof; the base cap covering the bottom side of the actuating member; a positioning block protruded from the base cap and located between the first receiving space and the second receiving space; the base cap having two third through holes opened therethrough; the two third through holes correspondingly communicating with the two driving holes;

each positioning block passing through each corresponding first through hole and being movable in each corresponding first through hole, each positioning block having a positioning plate defined at one end thereof, each positioning plate being opposite to each corresponding actuating member, a cross-sectional area of the positioning plate being larger than a cross-sectional area of the positioning block that is parallel to the plate, a width of the positioning block and a width of the positioning plate both being smaller than a diameter of the opening end of the first through hole so that when the positioning block is moved from the positioning end to the opening end, the positioning plate may pass through the opening end to remove the entire actuating member from the wrench body, the width of the positioning plate being larger than a width of the positioning end so that when the positioning block is within the positioning end, the wrench body is sandwiched between the positioning plate and the actuating member, the positioning plate being attached to a bottom plane of the wrench body and the actuating member is assembled to a top plane of the wrench body, so that the actuating member does not depart from the positioning end, the positioning block having an assembling aperture opened at a lateral side thereof, the assembling aperture corresponding to an inner wall of the first through hole, a flexible assembly received into the assembling aperture, the flexible assembly being abutted against one of the two positioning grooves after the positioning block is moved to the positioning end of the first through hole;

wherein when the positioning block is located in the opening end of the first through hole, a user rotates the actuating member relative to the wrench body so as to change the driving hole, so that the user unlocks screws with different size rapidly and easily.

2. The wrench device with a plurality of driving holes as claimed in claim 1, wherein the flexible assembly comprises a positioning ball and a first biasing element; one end of the first biasing element abuts against a bottom of the assembling aperture, and the other end of the first biasing element abuts against the positioning ball so that the positioning ball is limited at an opening of the assembling aperture; wherein when the positioning block is moved from the opening end of the first through hole to the positioning end of the first through hole, the positioning block is maintained in the positioning end because of the positioning ball and the first biasing element.

3. The wrench device with a plurality of driving holes as claimed in claim 1, wherein the wrench body further has two sub through holes opened at two ends thereof; a distance is defined between each sub through hole and the positioning end of each corresponding first through hole; the two sub through holes communicate with one of the two driving holes respectively when the positioning block is positioned in the positioning end of the first through hole.

4. The wrench device with a plurality of driving holes as claimed in claim 1, wherein each engaging block has a positioning protrusion protruding from the other side therefrom; the other end of each of the two flexible units is selectively abutted against one of two sides of the positioning protrusion corresponding thereto.

* * * * *